United States Patent [19]

Bard

[11] 4,294,379

[45] Oct. 13, 1981

[54] UPWARD VENTED TRASH RECEPTACLE FOR FLEXIBLE COLLAPSIBLE TRASH LINER

[76] Inventor: Robert A. Bard, 70 Hopatcong Dr., Lawrenceville, N.J. 08648

[21] Appl. No.: 70,179

[22] Filed: Aug. 27, 1979

[51] Int. Cl.[3] ..... B65D 25/16

[52] U.S. Cl. ..... 220/404; 220/1 T

[58] Field of Search ..... 220/1 T, 403, 404, 407, 220/408, 410

[56] References Cited

U.S. PATENT DOCUMENTS

| | | | |
|---|---|---|---|
| 1,736,192 | 11/1929 | Easton | 220/404 |
| 2,678,764 | 5/1954 | Carlson | 220/404 |
| 3,484,011 | 12/1969 | Greenhalgh | 220/404 |
| 3,648,920 | 3/1972 | Stump | 206/586 |
| 4,122,973 | 10/1978 | Ahern | 220/410 |

*Primary Examiner*—George E. Lowrance
*Attorney, Agent, or Firm*—Thomas R. Farino, Jr.

[57] ABSTRACT

An apparatus for holding a flexible, collapsible trash liner. A rigid upward vented trash receptacle receives a flexible, collapsible, trash liner and includes along the side walls of the upward vented trash receptacle a plurality of axially aligned and peripherily positioned hollow tubes which are interior to or part of (molded into) the vented trash receptacle's internal walls and open at both ends which terminate approximately 1" interior to the top and bottom of the upward vented trash receptacle. The hollow tubes allow ambient air to be drawn from the top of the tubes to the bottom of the tubes to reduce the vacuum created in the vacant space immediately below the flexible, collapsible trash liner as it is removed from the upward vented trash receptacle and thus facilitate removal of the flexible, collapsible trash liner. At the same time the upward vented trash receptable will contain leakage of most trash or other material even if the flexible collapsible trash liner breaks as well as most trash or other material without a flexible, collapsible trash liner installed. Since the top portion of the installed flexible, collapsible trash liner is normally just loosely folded over the upper rim of the upward vented trash receptacle, notches placed in the upper rim of the receptacle assist the vented tubes and allow some of the air trapped between the flexible, collapsible trash liner and the interior of the upward vented trash receptacle to more freely escape as the flexible, collapsible trash liner is filled with most trash or other material. A lid is provided for closing the top opening of the upward vented trash receptacle.

4 Claims, 3 Drawing Figures

UPWARD VENTED TRASH RECEPTACLE FOR FLEXIBLE COLLAPSIBLE TRASH LINER

BACKGROUND OF THE INVENTION

1. Field of the Invention

This invention is in the field of trash receptacles.

2. Description of the Prior Art

Many types of trash receptacles have heretofore been proposed for use in receiving flexible, collapsible trash liners and the like. A representative sample of the prior art is disclosed in the following U.S. patents:

U.S. Pat. No. 1,195,034 issued to A. E. Lang;
U.S. Pat. No. 1,613,621 issued to W. Qak,
U.S. Pat. No. 2,364,012 issued to R. R. Walton et al,
U.S. Pat. No. 2,678,764 issued to R. C. Carlson
U.S. Pat. No. 3,383,026 issued to B. L. McGee,
U.S. Pat. No. 3,610,455 issued to W. Greenhalgh et al
U.S. Pat. No. 3,815,778 issued to E. D. Martin.

A problem occurs when removing a flexible, collapsible trash liner from its trash receptacle in that a vacuum is created in the vacant space immediately below the departing flexible trash liner making it more difficult to remove the flexible, collapsible trash liner because the greater ambient air pressure holds the flexible, collapsible trash liner within the trash receptacle. An additional problem occurs when filling a flexible, collapsible trash liner which is mounted within a trash receptacle in that the air trapped between the flexible, collapsible trash liner and the interior walls of the trash receptacle prevents the flexible, collapsible trash liner from assuming a ready full configuration. The trash receptacle disclosed herein has been provided with a plurality of axially aligned and peripherily positioned hollow tubes which are interior to or part of (molded into) the upward vented trash receptacle's interior wall and through which ambient air is allowed to travel to reduce the vacuum created in the vacant space immediately below the flexible collapsible trash liner and thus reduce the total removal force required.

The positioning of the hollow conduit vent tubes internal to the exterior walls of the upward vented trash receptacle further permits unplanned leakage from the flexible, collapsible trash liner to be contained by the upward vented trash receptacle. Also, the hollow vented tubes in conjunction with the notched upper rim allow the air trapped between the flexible, collapsible trash liner and the upward vented trash receptacle interior wall to escape to the top opening of the receptacle and past the point where the flexible, collapsible trash liner is folded over the upper rim of the receptacle through the plurality of notches in the upper rim of the upward vented trash receptacle.

SUMMARY OF THE INVENTION

It is an object of the present invention to provide a new and improved apparatus for containing trash or other material with or without flexible, collapsible trash liners.

One embodiment of the present invention is an apparatus for holding a flexible, collapsible trash liner comprising a rigid upward vented trash receptacle having a main body with a closed bottom and an open top with a rim. The main body includes along the side walls of the upward vented trash receptacle a plurality of axially aligned and peripherily positioned hollow tubes for allowing ambient air to fill the vacant space between the departing flexible, collapsible trash liner and the bottom of the upward vented trash receptacle to reduce the vacuum created therein.

In addition, it is an object of the present invention to provide the main body with a plurality of notches in its upper rim to allow air trapped between the interior wall of the main body and the flexible, collapsible trash liner to escape as the flexible, collapsible trash liner expands during the filling thereof. Related objects and advantages of the present invention will become apparent from the following description.

BRIEF DESCRIPTION OF THE DRAWINGS

FIG. 3 is a further cross sectional view of the upward vented trash receptacle shown in FIG. 1 with the flexible, collapsible trash liner fully installed with a lid on.

DESCRIPTION OF THE PREFERRED EMBODIMENT

Figure 1:
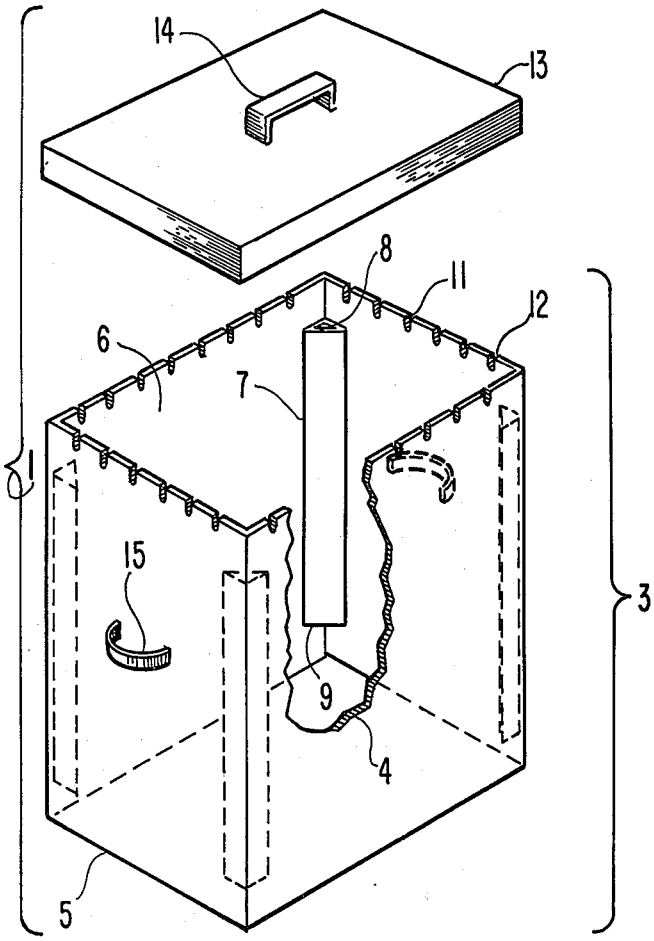
FIG. 1 is an exploded view of an apparatus incorporating the present invention.
Figure 2:
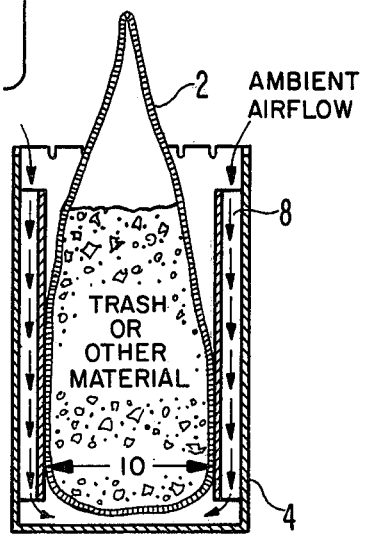
FIG. 2 is a cross sectional view of the receptacle shown in FIG. 1 having a flexible, collapsible trash liner being removed from the upward vented trash receptacle.

The above features and advantages of the present invention will become apparent with reference to the following detailed description taken in conjunction with the accompanying drawing in which:

FIG. 1 shows an apparatus 1 for holding a flexible and collapsible trash liner 2 shown in FIG. 2 (cross sectional view). Apparatus 1 includes a rigid upward vented trash receptacle 3 having a main body 4 with a closed bottom end 5 and an open top 6. The main body 4 includes along its side walls a plurality of axially aligned and peripherily positioned hollow conduit vented tubes 7 which are interior to or part of the interior wall of the upward vented trash receptacle and are open at both ends which terminate approximately 1" interior to the open top 6 and the closed bottom end 5 of the upward vented trash receptacle.

The hollow conduit vented tubes 7 allow ambient air to be drawn from the top 8 of the hollow conduit vented tubes 7 to the bottom 9 of the hollow conduit vented tubes 7 and around the piston (sliding) type seal 10 of the outer surface of the flexible, collapsible trash liner 2 with the inner surface of the upward vented trash receptacle main body shown in FIG. 2 to reduce the vacuum created in the vacant space immediately below the flexible, collapsible trash liner 2 as it is removed from the upward vented trash receptacle main body 4 and thus facilitate removal of the flexible, collapsible trash liner 2.

Figure 3:
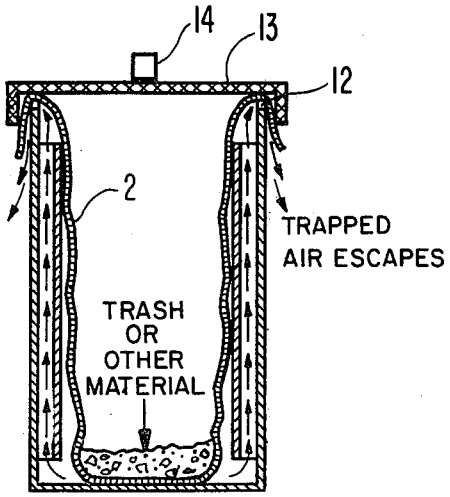

As shown in FIG. 3, the flexible, collapsible trash liner 2 has been inserted into the upward vented trash receptacle 3 and was folded over the open top rim 11 of the upward vented trash receptacle 3. The hollow conduit vented tubes 7 allow the air trapped between the flexible collapsible trash liner 2 and the main body 4 of the upward vented trash receptacle to escape first through the hollow conduit vented tubes 7 and second between the notches 12 in the rim 11 of the upward vented trash receptacle 3 and the folded flexible collapsible trash liner 2 as the flexible, collapsible trash liner 2 expands during the filling thereof. This advantage is permitted to take place even with lid 13 installed.

Lid 13, (of optional design, has a handle 14 secured thereto with the lid 13 being mountable over the open top 6 of the upward vented trash receptacle 3. The lid 13 may be of any design and may even be attached to the main body 4 of the upward vented trash receptacle 3. A pair of optional handles 15 are mounted to the main body 4 of the upward vented trash receptacle 3 to facilitate lifting of the upward vented trash receptacle 3.

Of course, the upward vented trash receptacle 3 will permit compaction and compression of most trash or other material in the flexible, collapsible trash liner 2 installed in the upward vented trash receptacle 3 while at the same time tending to prevent breaking of the flexible, collapsible trash liner 2.

Many variations in the present invention are contemplated and included. For example, even though the hollow conduit vented tubes 7 are shown here with a triangular shaped cross-section, their cross section may be square, rectangular, circular, etc. without changing their effectiveness. Also, the hollow conduit vented tubes 7 may be molded, along with the notches 12, into the walls of the upward vented trash receptacle 3 as a single unit or the hollow conduit vented tubes 7 may be separately attached with an adhesive, etc.

It will be apparent that other modifications and variations of the described embodiment may be effective without departing from the scope or spirit of this invention as defined in the appended claims.

The invention claimed is:

1. An apparatus for receiving a flexible and collapsible trash liner comprising:

a rigid upward vented trash receptacle having a main body with a closed bottom; a collapsible trash liner; and an open top with a rim containing circumferentially positioned notches for assisting the escape of air trapped between the walls of said main body and said trash liner; said main body including along its side walls a plurality of axially aligned hollow open ended conduits positioned in the corners of said main body and spaced sufficiently from said bottom and top of said receptacle to permit trapped air to flow out of said trash receptacle during the filling of said liner and to permit ambient air to flow into said trash receptacle as the liner is removed from said receptacle so as to reduce the vacuum created in the void between the exterior of said liner and the interior of said receptacle.

2. The apparatus of claim 1 in which said open ended conduits are molded into the side walls of said main body.

3. The apparatus of claim 1 in which said open ended conduits are detachably mounted to the inside walls of said main body.

4. The apparatus of claim 1, further comprising a lid removably mounted to the open rim portion of said main body.

* * * * *